US008591243B2

(12) United States Patent
Brune et al.

(10) Patent No.: US 8,591,243 B2
(45) Date of Patent: Nov. 26, 2013

(54) PLUG FOR MOISTURE-PROTECTED ELECTRICAL PLUG CONNECTION

(75) Inventors: Dominik Brune, Ostbevern (DE); Andreas Hanke, Osnabrück (DE); Juri Bugajew, Ibbenbüren (DD); Reinhard Hembrock, Hörstel (DE)

(73) Assignee: OASE GmbH, Hörstel-Riesenbeck (DE)

( * ) Notice: Subject to any disclaimer, the term of this patent is extended or adjusted under 35 U.S.C. 154(b) by 78 days.

(21) Appl. No.: 13/461,996

(22) Filed: May 2, 2012

(65) Prior Publication Data

US 2012/0282794 A1 Nov. 8, 2012

(30) Foreign Application Priority Data

May 6, 2011 (DE) ..... 10 2011 106 727

(51) Int. Cl.
*H01R 13/46* (2006.01)

(52) U.S. Cl.
USPC ..... 439/276; 439/936

(58) Field of Classification Search
USPC ..... 439/276, 936, 587.589
See application file for complete search history.

(56) References Cited

U.S. PATENT DOCUMENTS

| | | | | |
|---|---|---|---|---|
| 4,854,886 | A * | 8/1989 | Neuroth | 439/192 |
| 5,274,603 | A * | 12/1993 | Zibilich et al. | 367/20 |
| 5,286,220 | A * | 2/1994 | Watson | 439/589 |
| 6,231,388 | B1 * | 5/2001 | Murakami et al. | 439/587 |
| 6,802,741 | B1 * | 10/2004 | Shatkin | 439/620.21 |
| 6,935,886 | B2 * | 8/2005 | Hoch et al. | 439/462 |

FOREIGN PATENT DOCUMENTS

| | | |
|---|---|---|
| DE | 10 2009 060 564 A1 | 6/2011 |
| WO | 2011/076399 A1 | 6/2011 |

* cited by examiner

*Primary Examiner* — Gary F. Paumen
(74) *Attorney, Agent, or Firm* — Gudrun E. Huckett

(57) ABSTRACT

A plug for a moisture-protected electrical plug connection has a plug housing having an interior and contact elements secured in the plug housing. Electrical lines extend through the plug housing and are each conductively connected by an electrical connection to one of the contact elements. The electrical lines each have an enveloping insulation. A potting compound fills out the interior of the plug housing. The electrical lines each have a first area without insulation adjoining the electrical connection. An electrically non-conductive spacer is arranged between the first area and the electrical connection. The first area, on a side of the spacer facing away from the electrical connection, is embedded in the potting compound.

11 Claims, 1 Drawing Sheet

PLUG FOR MOISTURE-PROTECTED ELECTRICAL PLUG CONNECTION

BACKGROUND OF THE INVENTION

The invention relates to a plug for moisture-protected electrical plug connections, comprising a plug housing and at least two contact elements secured on the plug housing and each conductively connected to an electric line, respectively, extending through the plug housing and having an enveloping insulation, wherein the plug housing interior is at least partially filled with a potting compound.

DE 10 2009 060 564 A1 discloses a plug connection arrangement that comprises additional sealing elements. In this way, significant improvements in regard to moisture protection are achieved. Inasmuch as the connection itself is however insufficiently attached such that the seals of the plug connection cannot properly develop their function or in case of a damaged cable, defects may occur also within the plug. In case of plugs that are used in environments where they are exposed to moisture, in particular in underwater applications, there is often the problem that moisture that enters through capillary action along the individual electrical lines can enter the plug or can be conducted further within the plug where it can cause irreparable damage in the plug itself or in the connected devices.

SUMMARY OF THE INVENTION

It is therefore an object of the invention to improve a plug with regard to protective properties against moisture.

In accordance with the invention, this is achieved in that the electrical lines each have at least one area without insulation adjoining the electrically conducting connections with the contact elements, wherein between these areas without insulation and the electrically conducting connections with the contact elements at least one electrically non-conductive spacer is arranged, and in that at least the (partial) areas without insulation, on the side of the spacer that is facing away from the electrical connections to the contact elements, are embedded in the potting compound.

Accordingly, the individual electrical lines, each enveloped or enclosed by individual insulation, within the plug cable, have partially the insulation removed, namely not only at their ends where the electrically conducting connection is realized in particular by soldering with the contact elements, but also within an area beyond wherein this area, upon completion of the plug, is surrounded by or embedded in the potting compound. In the potting process (carried out under vacuum), the potting compound completely encloses the bare wires and seals them reliably. Embedding in the potting compound blocks the capillary action. In order for the areas without insulation not to contact each other and cause a short during manufacture of the plug, according to the invention it is provided that at least one electrically non-conductive spacer is used that spaces apart the areas without insulation.

When producing electrical connections with electric cables, usually first the cable jacket is partially removed and then, at the ends of the individual electrical lines, the individual insulation is removed, respectively. In the meaning of the invention, areas without insulation are to be understood not only as those areas of the electrical lines in which the prior insulation has been removed but also those areas that possibly from the beginning did not have any insulation, i.e., electrical lines that have been produced without insulation.

Preferably, the non-conductive spacer in the finished plug is also surrounded by or embedded in the potting compound and is fixed in position and secured by the potting compound. In addition to the partial areas with removed insulation that are embedded in the potting compound and located on the side of the spacer that is facing away from the contact elements, further areas without insulation may be present also in front of the spacer, i.e., between the contact elements and the spacer. These further areas are also enclosed by or embedded in the potting compound. The spacer is then arranged between two partial areas from which insulation has been removed and that are embedded in the potting compound. This increases the water tightness in the longitudinal direction (along the wires or electrical lines) even more.

Preferably, the spacer is not connected immediately with the plug housing of the plug. In particular, a connection to the plug housing is provided exclusively by means of the potting compound and/or the cable or the electrical lines themselves. In this way, the production of the plug is simplified but, still, once the potting compound is cured, the electrical lines and the spacer are secured and immobile within the plug housing.

An especially preferred embodiment resides in that the spacer is formed by remaining sections of insulation. The sections of insulation are arranged between the electrical line ends that are connected electrically with the contact elements and the areas where the insulation has been removed and that are embedded by the potting compound and serve for providing water tightness in the longitudinal direction. In case of very flexible, i.e., thin or soft electrical lines it may be advantageous to arrange between the areas without insulation and the cable jacket, i.e., the outer insulation of the cable, at least one spreader element that prevents contact of the electrical lines in the areas without insulation. This may be required because a certain minimum length of removed insulation is desirable for ensuring the water tightness in the longitudinal direction. When the lines are however very thin or soft and therefore too flexible, possibly, despite the spacer being arranged in the area without insulation, contact may happen during production of the plug. In particular in so-called multi-wire data lines with typically small cross-section, such spreader elements may thus be advantageous. The spreader element, for example, can be formed by shrink hose sections that are pushed onto the individual electrical lines. In case of thicker electrical lines with inherent stiffness, so-called power lines usually with only two data lines and larger cross-section (usually >0.5 $mm^2$), the insulation of the individual electric lines is usually thick enough in order to prevent contact of the individual electrical lines or strands with each other so that an additional spreader element is generally not required.

BRIEF DESCRIPTION OF THE DRAWING

Further advantages and details result from the dependent claims and the embodiments of the invention illustrated in the drawing which will be explained in the following in more detail.

DESCRIPTION OF THE PREFERRED EMBODIMENTS

Figure 1:
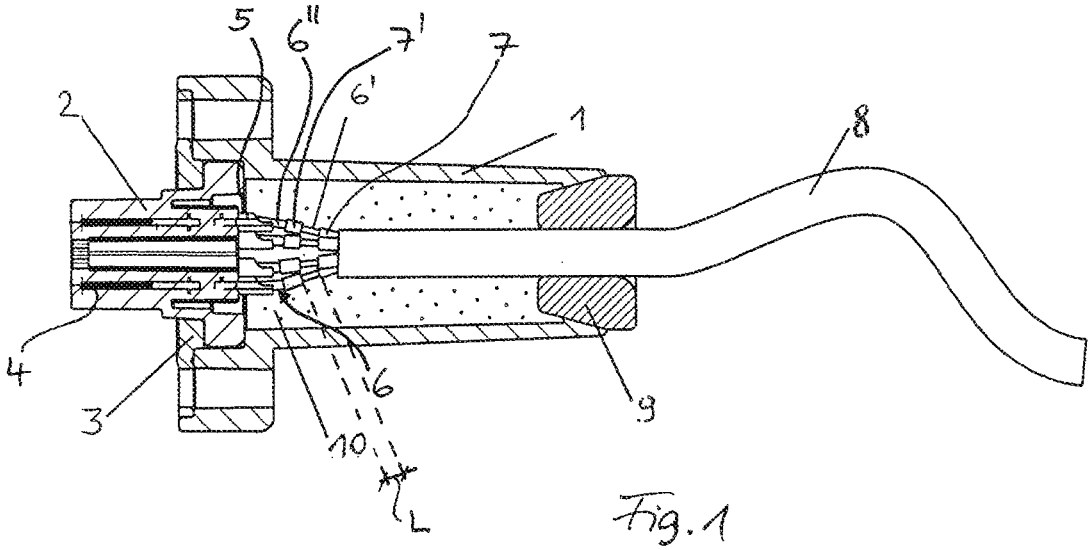
FIG. 1 shows a plug according to the invention in longitudinal section.

The plug illustrated in FIG. 1 has a plug housing 1 that has inserted therein a contact support 2 at the front end. In addition, the front end of the plug is provided with a profiled seal 3. In the contact support 2, contact elements 4 are secured that are connected by means of contact pins 5 conductively with electrical lines 6. The electrical lines 6 each have an insulation 7 enclosing them and they are combined to an electrical cable 8 with a cable jacket surrounding them over the further course of extension. The electrical cable 8 exits from the plug housing 1 at the rearward end and extends away from the plug housing 1; the rearward end of the plug housing 1 is sealed by a seal 9.

According to the invention, between the electrical connection with the contact elements 4 and the joining location where they are combined to form the electrical cable 8, the individual electrical lines 6 each have an insulation-free area 6', i.e., an area without insulation or an area where the insulation has been removed. These areas 6' are surrounded by or embedded in a potting compound 10 that fills out the interior of the plug housing 1. In accordance with the invention, a spacer is provided between the areas 6' without insulation and the electrically conducting connections with the contact elements 4 (in the illustrated embodiment, this connection is provided by means of contact pins 5) in order to prevent that during mounting of the plug the insulation-free areas 6' of the electrical lines 6 contact each other. The spacer in the illustrated embodiment is formed by remaining sections of the insulation 7' that space apart the electrical lines 6 in this area. Preferably, these insulation sections 7' or the spacer is also embedded in the potting compound 10 for stabilizing purposes. Also, in front of the insulation sections 7' a further partial area 6" without insulation may be provided, respectively, that may also be embedded in the potting compound 10 for further improving the seal-tightness.

In order to achieve a satisfactory wetting and embedding with the potting compound 10, the areas 6' without insulation should have a length L of 3 mm, preferably even 5 mm, behind the spacer 7'. Since however a length L that is too large could have the effect that the areas 6' without insulation might contact each other upon mounting, this length L should not be greater than 20 mm, preferably even maximally 10 mm.

Figure 2:
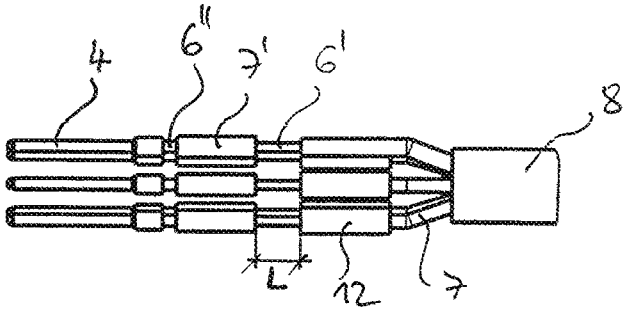
FIG. 2 shows a further embodiment of the electrical lines as they may be arranged in the plug housing.

In case of very thin and/or flexible electrical lines 6, despite of this precaution, contact of the areas 6' without insulation with each other may occur as long as they are not yet embedded in the potting compound 10. In order to prevent this, it is advantageous to use at least one additional spreader element. The spreader element should be arranged preferably in the transition area between the area 6' without insulation and the insulation 7 enveloping it. The spreader element can also surround the enveloping insulation 7 in front of the location of joining to form the cable 8. This spreader element can be preferably formed by spreader element sections 12 that are pushed onto the individual lines 6, as illustrated in FIG. 2. These spreader element sections 12 are preferably shrink hose sections. In this way, the spreader element sections 12 act essentially as a thicker portion or reinforcement of the insulation 7 and therefore provide a further spacing apart of the area 6' without insulation.

The plug according to the invention has an excellent water tightness in longitudinal direction and is therefore very safe even when used under water. This improved seal tightness is achieved according to the invention in a constructively simple way without increasing significantly the production costs.

The specification incorporates by reference the entire disclosure of German priority document 10 2011 106 727.6 having a filing date of 6 May 2011.

While specific embodiments of the invention have been shown and described in detail to illustrate the inventive principles, it will be understood that the invention may be embodied otherwise without departing from such principles.

What is claimed is:

1. A plug for a moisture-protected electrical plug connection, the plug comprising:

a plug housing having an interior;

contact elements secured in said plug housing;

electrical lines extending through said plug housing and each conductively connected by an electrical connection to one of said contact elements, respectively;

said electrical lines each having an enveloping insulation;

a potting compound filling out said interior of said plug housing;

wherein said electrical lines each have a first area without insulation adjoining said electrical connection;

an electrically non-conductive spacer arranged between said first area and said electrical connection;

wherein said first area is embedded in said potting compound on a side of said spacer facing away from said contact elements.

2. The plug according to claim 1, wherein said spacer is embedded in said potting compound.

3. The plug according to claim 1, wherein said electrical lines each have a second area without insulation and said second area is located between said electrical connection and said spacer, wherein said second area is embedded in said potting compound.

4. The plug according to claim 1, wherein said spacer is not immediately connected to said plug housing.

5. The plug according to claim 1, wherein said spacer is formed by a section of said insulation.

6. The plug according to claim 1, wherein in a transition area between said first area without insulation and said insulation at least one spreader element is arranged that prevents said electrical lines from contacting each other.

7. The plug according to claim 6, wherein said spreader element is formed by individual shrink hose sections pushed onto said electrical lines.

8. The plug according to claim 1, wherein said first area has a length of at least 3 mm.

9. The plug according to claim 1, wherein said first area has a length of at least 5 mm.

10. The plug according to claim 1, wherein said first area has a length of maximally 20 mm.

11. The plug according to claim 10, wherein said first area has a length of maximally 10 mm.

* * * * *